United States Patent [19]

Browning

[11] Patent Number: 4,604,306

[45] Date of Patent: Aug. 5, 1986

[54] ABRASIVE BLAST AND FLAME SPRAY SYSTEM WITH PARTICLE ENTRY INTO ACCELERATING STREAM AT QUIESCENT ZONE THEREOF

[76] Inventor: James A. Browning, P.O. Box 6, Hanover, N.H. 03755

[21] Appl. No.: 765,987

[22] Filed: Aug. 15, 1985

[51] Int. Cl.[4] ..... B05B 1/06; B05B 1/24; B05D 1/10

[52] U.S. Cl. ..... 427/423; 427/34; 219/121 PL; 239/79; 239/81

[58] Field of Search ..... 239/79, 81, 85; 118/300; 427/423, 34; 219/121 PL

[56] References Cited

U.S. PATENT DOCUMENTS

| | | | |
|---|---|---|---|
| 3,136,484 | 6/1964 | Dittrich | 239/79 |
| 3,573,090 | 3/1971 | Peterson | 239/81 X |
| 3,958,097 | 5/1976 | Fabel et al. | 219/121 PL |
| 4,192,460 | 3/1980 | Matsuo | 239/79 |

FOREIGN PATENT DOCUMENTS

| | | | |
|---|---|---|---|
| 225292 | 1/1943 | Switzerland | 427/423 |

*Primary Examiner*—Shrive P. Beck
*Attorney, Agent, or Firm*—Sughrue, Mion, Zinn, Macpeak & Seas

[57] ABSTRACT

A high velocity gaseous jet stream which may be a cold jet stream of compressed air or a jet flame discharging from an internal burner discharges through an open slot V-shaped, U-shaped or C-shaped, or alternatively through separate circumferentially spaced parallel passages to form a volumetric zone of quiescent gas well into the main jet prior to downstream folding of the quiescent zone to form a single symmetrical jet stream, thereby permitting abrasive particles for sandblasting, a solid material particles which are subsequently melted or at least heat-softened prior to impact on a substrate for spray coating. As such the gaseous accelerating medium does not interference with the introduction of the particle or the solid rod from which the particles separate after melting to the center of the accelerating stream, thereby maintaining concentricity of the gas stream about the particles facilitating the focusing of the particle stream and maximizing acceleration effect to the particles so introduced.

10 Claims, 6 Drawing Figures

FIG. 1a
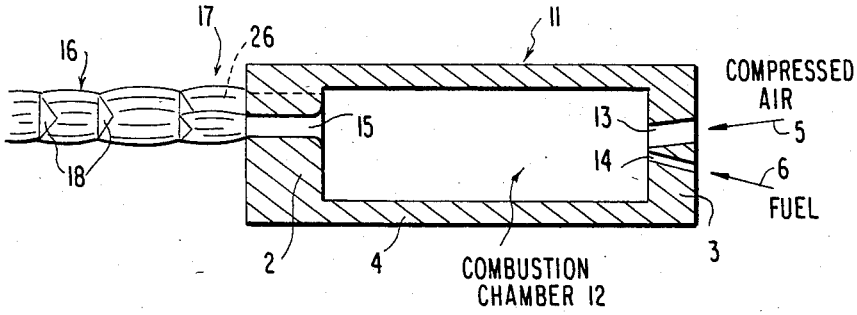
FIG. 1b
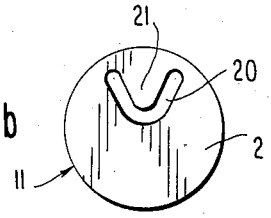
FIG. 2
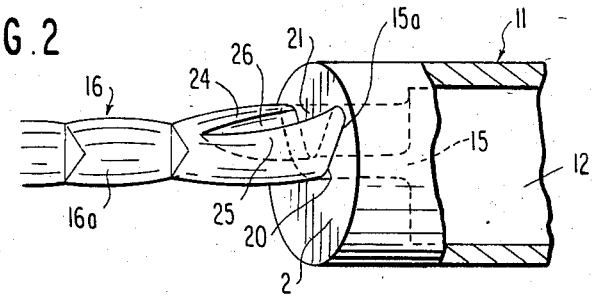
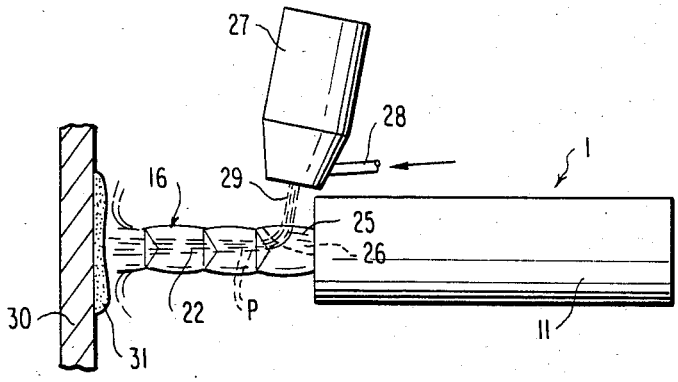
FIG. 3

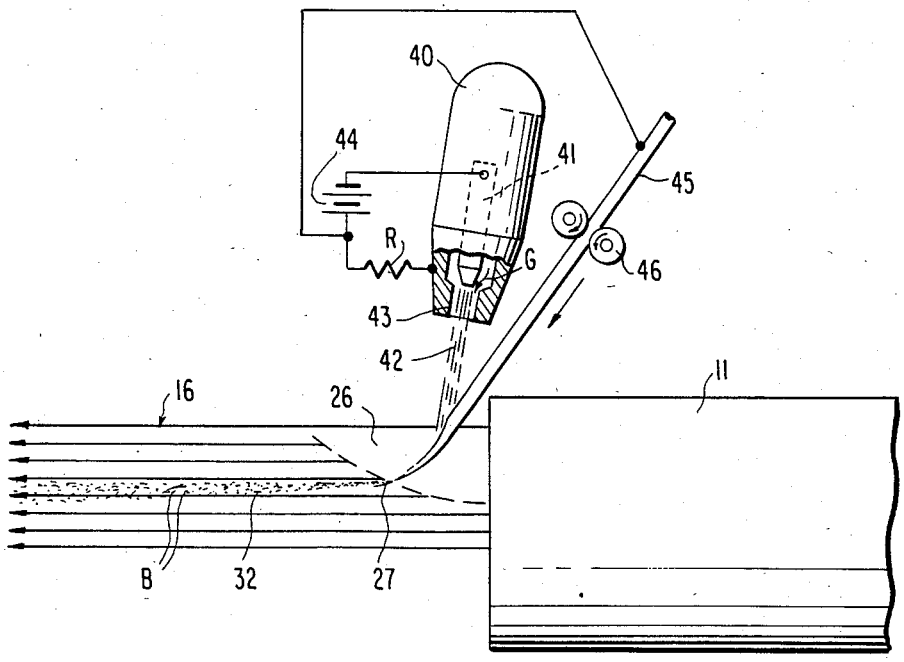
FIG. 4
FIG. 5
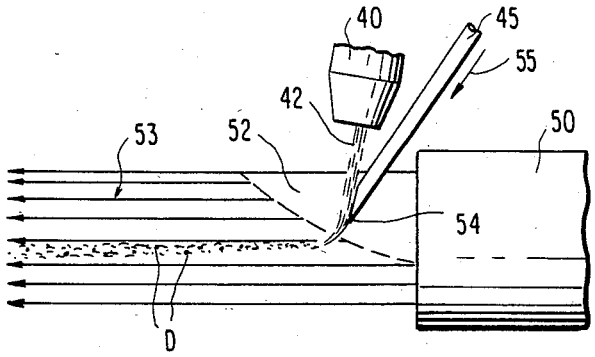

ABRASIVE BLAST AND FLAME SPRAY SYSTEM WITH PARTICLE ENTRY INTO ACCELERATING STREAM AT QUIESCENT ZONE THEREOF

FIELD OF THE INVENTION

This invention relates to the utilization of supersonic gas flow as accelerating medium for molten particles to velocities adequate for forming superior flame sprayed coatings, and for accelerating abrasive particles to maximize the abrasive blast capability of a gas-accelerated blast apparatus, and more particularly to such systems and their method of operation wherein the particles to be flame sprayed or accelerated as solid abrasive blast particles are introduced radially to the accelerating stream without adverse effect by the stream on the particles or the materials so introduced.

BACKGROUND OF THE INVENTION

In a continuing effort to simplify the use of electric arcs with metal wire for flame spraying purposes, the applicant has discovered that the optimum situation results when the arc intersects the wire (usually as the anode) within a region characterized by a quiescent atmosphere. Any significant motion of the ambient gases surrounding the wire can violently effect arc action, even extinguishing it. To date, the only practical, arc-wire system utilizes two separate wires. The wires are continuously fed toward each other and an arc is formed between their ends by subjecting a potential difference across the wires. A blast of compressed air directed at the arc is used to accelerate the molten material to the required velocity to form coatings. The air blast disrupts the arc, it is believed that the wires momentarily touch to cause a short-circuit. The wire melts back causing a short arc of very short life. The wires again approach each other and the process repeats many times per second. The arcing action is very unsteady with the result that a very wide range of molten particles are produced. This, in itself, is not bad. But, the presence of oversized particles diminishes coating quality.

The two-wire system has a second disadvantage in that one of the wires must be the cathode. Cathode temperatures can be much higher than that at the anode. In some cases an appreciable overheating of the metal causes a change in metallurgy as well as vaporizing a small amount of it.

With these drawbacks of the two-wire system in mind, attempts were made to produce an arc-wire system capable of achieving top quality coating while using only a single wire serving as the anode. An attempt was made to heat the wire used as an "open" welding arc such as that produced by a tungsten-inert gas ("T.I.G."). The arc was directed against the moving wire from a fixed cathode and the anode spot would affix itself to a particular heated point on the wire drawing the arc, to a length such that required voltage became greater than that provided by the power supply. As such, the arc went out even in a quiescent atmosphere. It soon became apparent that a much "stiffer" arc column was required; one which would keep the anode spot and arc column in a fixed spatial geometry.

It became apparent that to solve the wandering arc problem it was necessary to turn to commercially available transferred plasma-arc cutting equipment. The applicant found that the plasma-arc equipment utilizes a small flow of gas (such as nitrogen) to position and direct the arc column through and beyond the torch nozzle and even though this gas is raised to extreme temperatures and possesses high velocity, it was determined that there is simply not enough of it to act as an effective accelerator for molten materials. Further, attempts to use plasma-arc as a melter, passing a high velocity flow of compressed air axially along the wire, failed. Again, the arc voltage jumped to unsustainable levels with termination of the arc. From these tests, it became apparent that the plasma-arc and the anode spot were subjected to the gaseous accelerating medium and the interference was fatal.

It is, therefore, a primary object of the present invention to provide an arc-wire flame spray system which separates the arc melting of the wire from the gas flow used to accelerate the molten particle to velocities adequate for forming superior flame spray coating, or to equivalent systems and to effect introduction of the flame spray particle into the accelerating medium without any interference by the gaseous accelerating medium to the flame spray source.

It is a further object of the invention to provide an arc-wire flame spray system in which, the accelerating medium is provided with an inherent quiescent zone at the point of contact with the flame spray stream emanating from the plasma source so as to envelope the flame spray without interference by the gaseous accelerating medium.

BRIEF DESCRIPTION OF THE FIGURES

FIG. 1*a* is schematic, longitudinal cross-sectional view of an internal burner forming one component of the arc-wire flame spray system of the present invention.

FIG. 1*b* is an end view of the burner of FIG. 1*a* showing the configuration of the nozzle exit.

FIG. 2 is a perspective view of a portion of the internal burner of the nozzle end of the burner of FIG. 1 and U-shaped flame jet exiting from the nozzle.

FIG. 3 is a schematic, vertical elevational view of one embodiment of the arc-wire flame spray system of the present invention for accelerating, molten or heat-softened powder material emanating from a conventional flame spray torch as a component thereof.

FIG. 4 is a schematic elevational view, partially broken away of the system FIG. 3 modified to the extent of effecting acceleration of melted particles from a wire via a transferred-arc plasma torch.

FIG. 5 is a schematic, side elevational view of an arc-wire flame spray system employing a compressed air jet as the accelerating stream and forming yet another embodiment of the present invention.

DESCRIPTION OF THE PREFERRED EMBODIMENT

The present invention makes use of several arc-wire flame spray systems. In essence, the basic principle of the present invention is the creation of a high velocity gaseous jet stream with an initial quiescent zone, particularly at the area of introduction of the flame spray particles to the accelerating stream such that the volumetric zone of quiescent gas penetrates well into the main jet itself and permits the main jet gases to fold together downstream of the quiescent zone to form a single, symmetric jet stream encompassing and indeed focusing the particles as they accelerate to maintain a particle core for the accelerating stream concentrically surrounding the particle stream, at the center or core of the jet. The jet gases may be produced by the continuous combustion of a fuel and oxidizer mixture within an internal "rocket" burner, a plasma torch, or a flow of compressed air at high velocity.

Referring to FIG. 1, an internal burner indicated generally at 11 is cylindrical in form, consisting of a metal cylinder or tube 4 closed at its ends by end walls 2, 3. The internal burner cylinder 11 and the end walls 2,3 define a combustion chamber 12 in which reactants of an oxidizer and fuel are continuously burned. Appropriately, compressed air, indicated by arrow 5, is continuously fed to the combustion chamber 12 via an injector hole or passage 13. A likewise oblique passage or injector hole 14 within end wall 3 is supplied, with a continuous flow of fuel as indicated schematically by arrow 6. Pure oxygen or oxygen-enriched air, may be substituted for the ordinary compressed air 5. The air and fuel are forced through the injector holes into the combustion chamber 12 where the reactants are burned at high pressure. The hot products of ignition is effected in the manner of applicant's U.S. Pat. No. 2,990,653 entitled "METHOD AND APPARATUS FOR IMPACTING A STREAM OF HIGH VELOCITY AGAINST THE SURFACE TO BE TREATED" issued July 4, 1961, and the contents thereof are incorporated herein by reference. The hot products of combustion issue through a noncircular nozzle 15 within end wall 2 to form supersonic jet stream 16. This stream is characterized by shock diamonds 18, which result from supersonic stream velocity. A region 17 adjacent to the nozzle exit plane contains a quiescent zone 26. It is a key element of the present invention in all embodiments.

FIG. 1*b* is an end view of internal burner 11 showing one form of a noncircular nozzle passage 20. In this case, the passage has a cross-sectional configuration of U-shaped to form a separating structure or section of end wall 2 as at 21, just beyond which the quiescent zone 26 forms. The nonseparating structure 21 forms a circumferential gap in the discharged gas stream, creating quiescent zone 26, that extends to the center of the gas stream downstream of outlet of exit end 15*a* of nozzle 15.

FIG. 2 is a perspective view which illustrates to a greater degree the form of the jet stream 16, shaped by the U-nozzle slot 20 for nozzle 15. Dynamic forces draw the separated gas flow of the oblique arms of the U-shaped slot 20 together to form a full circular jet portion 16*a* of the jet stream 16, a short distance beyond the nozzle exit 15*a*. The quiescent zone 26 is contained between the lateral boundaries 24 and 25 formed by the U-shaped nozzle slot 20. The creation of the quiescent zone 26 permits the material to be introduced radially into the quiescent zone and pass to the center of the jet flow stream without contacting the supersonic velocity gases to reach that center. The very introduction of particulate matter into the outer edge of the circular jet stream is quite ineffective for producing acceleration desired for flame spray purposes. The particles tend to remain with the slower flowing gases of the outer jet boundary with the atmosphere or are thrown back into the atmosphere.

As may be appreciated by reference to FIGS. 1*a*, 1*b* and 2, the principles of the invention have equal application to technologies where solid particles are to be accelerated to extremely high velocity, i.e., supersonic as in abrasive blast cleaning. The embodiments described herein are particularly restricted to flame spray applications. In addition, although the various embodiments illustrate the nozzle slot as being of generally U-shaped, various open slot configurations are employable for the nozzle, for instance, V-shaped or C-shaped as long as there is a circumferential gap in the slot geometry. Additionally, a quiescent zone may be created between bifurcated accelerating gas streams discharging from an internal burner type combustion chamber for instance (or is equivalent) through a series of radially circumferentially spaced parallel discharge ports wherein the gas streams merge some distance from the end wall to the combustion chamber and wherein, the particles may be introduced through the quiescent zone or gap between any two parallel flow streams adjacent to the end wall 2 bearing the parallel small diameter discharge ports.

Turning next to FIG. 3, there is illustrated generally at 1 an arc-wire flame spray system 1 of the present invention in which, internal burner 11 is identical to that shown in FIGS. 1*a*, 1*b* and 2. Further, the conventional plasma spray torch 27 has a powder supplied, as indicated by arrow via feed tube 28, to produce a spray column 29 of molten or heat-softened particles. The plasma spray torch 27 is oriented such that column 29 is directed to flow into quiescent zone 26 and the particles P penetrate to the center of the flame-jet 16. The particles form an axially aligned geometry 22 or core and are accelerated to high velocity against plate 30, and form a coating 31 thereon. Although a plasma torch 27 is shown in FIG. 3, it should be understood that any conventional flame spray device in which the stream of heated particles project beyond the device's end face, may be substituted therefor. Where the material to be flame-spray has a melting point well below the jet temperature (in aluminum, zinc and copper being examples), it may be passed into and through the quiescent zone in either solid wire or powder form. As may be appreciated, in the embodiment of the invention shown in FIG. 3, the particles are indeed liquid as they are discharged in the column 29 and prior to entry into the center of the flame jet 16 at quiescent zone 26.

FIG. 4 illustrates the principles of the invention in another embodiment in which the flame spray system 15 has a separately fed wire 45 melted by a plasma-arc jet 42 at quiescent zone 26. In this embodiment, internal burner 11 is again, in accordance with showings in FIGS. 1*a*, 1*b* and 2. A plasma torch 40 is positioned at a slight back-angle such that the intersection of its arc column 42 with wire 45, is, in part, within quiescent zone 26. The plasma torch 40 incorporates an inner cathode electrode 41 which forms one terminal of the arc; the other being wire 45. A power supply indicated schematically by battery 44 is directly connected to the inner electrode 41 (anode), while the torch volume (for pilot arc purposes) is connected to the opposite polarity through a resistance R. A gas flow indicator indicated by the arrow G flows through plasma torch nozzle 43 to form the "stiff" arc column 42 which impinges its anode spot on wire 45 at a fixed position (in space) regardless of wire motion. This fixed position only results where gas velocities alone or across the wire are very low as occurs in the case for quiescent zone 26. The utility of a system specially creating a quiescent zone 26 under these conditions is apparent from viewing FIG. 4. The wire is rapidly melted away from its arc side. Maximum spray rates are achieved when the wire speed is adjusted to that rate in which a thin extended strand 27 of the wire projects beyond quiescent zone 26 and into the center of the main jet flow 16. Final melting of the wire is effected by a hot-flow. This is especially appropriate where an internal burner such as burner 11 employs its products of combustion at supersonic velocity as the accelerating stream for the particles B borne by the main jet flow 16 at the center thereof. Materials from the wire 45 as it is fed by rolls 46 is caused to melt upon contact with the arc column 42 and flows along the diminishing wire section to the pointed end of strand 27. Very fine droplets B are formed from ligaments extending from the end of strand 27. Thus, this arc-wire system produces an atomization regime more similar to an oxi-fuel spray torch than to its twin-wire counterpart. Spray column 32 is quite narrow and confined by the accelerating stream 16. The applicant has found that when using a plasma-arc cutting torch operating at about 200 volts, that the wire melt rate is about 0.2 pounds per hour for steel per ampere of current flow. Thus operation at 500 amperes results in a spray rate of 100 pounds per hour. This is significantly greater than available by any present commercial spray device. The other half is transferred from the intensely hot gas comprising the arc and its enveloping sheath. It is this gas flow which propels the molten film along the wire to tip 27. This advantageous geometry does not result for twin-wire spraying and as a result much finer and more dense coatings are now possible utilizing the system as shown in FIG. 4.

Although the jet form of an internal burner (a plasma torch) produces maximum melt-off rates and the highest quality coatings, in many cases ordinary compressed air flows are quite adequate and the system will operate capably where compressed air is caused to exit through a discharge slot taking the configuration of that shown in FIG. 1*b* in a section transverse to the direction of flow, through a suitable body bearing such slot. In such an arrangement, equipment complexity and weight are minimized. Sound levels are significantly reduced. FIG. 5 illustrates such a system utilizing compressed air as the accelerating stream. A similar quiescent zone 52 is formed by such a U-shaped nozzle of element 50 substituted for internal burner 11. In this case, the wire 45 is fed at a speed which results in a complete melting with the wire tip remaining in the quiescent zone 52. If paired, driven rolls as at 46 in FIG. 4, are likewise employed in feeding wire in the direction of the arrow 55 in this embodiment at rates which are too high, the wire 45 could be caused to completely pass through or penetrate beyond the quiescent zone 52 as formed by the U-shaped nozzle (not shown) of element 50. If the tip 54 were to extend into the jet flow 53, the wire would be rapidly cooled by the expanded flow of compressed air. However, it penetrates only into the quiescent zone 52 and is melted prior to penetration to that extent. The droplets D remain within the accelerating gas stream 53, are centered therein, and improved stream focusing occurs.

While the description of the invention in terms of the illustrated embodiments uniformly employ a U-shaped nozzle, other nozzle geometries are particularly applicable. Multiple holes arranged in a circular pattern but omitting one or more on the particle or wire feed side are useful alternatives assuming that the multiple holes are sufficiently circumferentially spaced to inherently create a quiescent zone therebetween for a short distance beyond the end of the body bearing the multiple parallel holes. A flat row of holes or a straight slot arranged perpendicular to the feed line may be satisfactory. The main aspect of the invention is to form a noncircular jet which, due to the dynamic forces combine into a circular jet a short distance downstream from the nozzle exit end of the body bearing the gas under pressure, creating the accelerating flow stream; and the introduction into the quiescent zone thereby created, materials to be heat or accelerated, or both. An alternative to forming the quiescent zone by specially shaped nozzle slot, i.e., V-shaped, C-shaped or U-shaped, would be to use a circular cross-section jet and placing an obstacle therein to cause such a quiescent zone to occur. Another variation of the invention is, rather than using rods or particulate matter to force a molten stream of the material to be sprayed into the quiescent zone. Plastic materials are particularly suitable to be heat-softened and sprayed by the principles of the invention. Additionally, abrasive particles which function to create an abrading stream but in which melting is undesirable and intolerable, may be readily introduced into the stream at a quiescent zone with advantageous results particularly having to do with focusing and maintaining concentricity of the solid particle stream relative to the accelerating stream completely surrounding the same, downstream of the quiescent zone. Plastic materials are particularly suitable to be heat-softened and sprayed by the principles of the invention. It is possible to adjust the jet temperature to that which will heat-soften but will not damage the plastic being accelerated prior to impact against the substrate for coating thereon. Further, the applicant envisions the creation of an intensely hot flame jet resulting from the combustion of such metal as aluminum in a stream of oxygen, at lower and upper edges of that lukewarm component. These members may be rectangular, of even width throughout their length, oval or of other appropriate configuration.

While the invention has been described in detail with reference to certain specific embodiments, various changes and modifications which fall within the spirit of the invention and scope of the appended claims will become apparent to the skill artisan. The invention is, therefore, only intended to be limited by the appended claims or their equivalents, wherein applicant has endeavored to claim an inherent novelty.

I claim:

1. An improved flame spray method comprising the steps of:

forming a primary jet stream of particulate material suspended in a carrier gas; forming a high velocity gaseous jet of non-circular geometry with a quiescent zone extending from the outer edge of the projected, to be formed circular jet, to well into the center of said jet, and introducing said stream of particulate material into said quiescent zone for subsequent acceleration of the particulate matter to high velocity and concentration thereof at the center of the accelerating stream wherein dynamic forces draw the non-circular flow of gases into a singular circular jet beyond said quiescent zone, capturing the particulate matter introduced within the quiescent zone.

2. The improved flame spraying method as claimed in claim 1, wherein said primary stream of particulate material is either molten or heat-softened and wherein said accelerating gas is an extremely hot gas stream.

3. The method as claimed in claim 2, wherein said step of forming a high velocity, gaseous accelerating stream jet of non-circular geometry comprises providing a flow of expanded compressed air or other low temperature gas.

4. The improved flame spraying method as claimed in claim 1, wherein said step of forming a high velocity gaseous accelerating stream jet of non-circular geometry comprises discharging a flow of expended products of combustion from an internal burner at supersonic velocity.

5. An improved flame spray apparatus comprising; means forming a primary jet stream of particulate material suspended in a carrier gas, means forming a high velocity gaseous accelerating stream jet of non-circular geometry exhibiting a quiescent zone, means for projecting the primary jet stream into the quiescent zone of the gaseous accelerating stream jet to the center thereof for subsequent acceleration of the particulate matter to high velocity wherein dynamic forces draw the non-circular flow of gases at said quiescent zone into a singular circular jet capturing the particulate material and maintaining the material in the center of the accelerating stream downstream of said quiescent zone.

6. The flame spray apparatus as claimed in claim 5, wherein said means for forming the high velocity gaseous accelerating stream jet comprises an internal burner having an essentially closed combustion chamber opening at one end by a discharge nozzle and wherein, the discharge nozzle has a non-circular geometry opening leading to the exterior of the combustion chamber, and said internal burner includes means for supplying a fuel and oxidizer continuously to the combustion chamber for ignition therein to form hot products of combustion which pass through the nozzle to form a supersonic flame jet.

7. The apparatus as claimed in claim 5, wherein said means forming a primary jet stream of particulate material suspended in a carrier gas comprises a plasma spray torch, a powder feed tube connected to the spray torch for feeding particulate material in powder form to the plasma spray torch, and said plasma spray torch includes means for discharging the powder within a small column as molten or heat-softened particles for projection into the quiescent zone.

8. The apparatus as claimed in claim 5, wherein said means forming a primary jet stream of particulate material suspended in a carrier of gas includes means for supplying to the plasma spray torch material to be flamed sprayed having a melting point well below the temperature of the high velocity gaseous accelerating stream jet.

9. The apparatus as claimed in claim 5, wherein said means forming a primary jet stream for particulate materials suspended in a carrier gas comprises; a plasma arc torch wherein a wire is fed axially into the quiescent zone and constitutes one of the electrodes for said plasma arc torch and wherein the plasma arc torch is positioned at a back-angle such that the intersection of its arc column with the wire is in part within the quiescent zone, whereby, gas flow through the plasma arc torch nozzle forms a stiff arc column which impinges its anode spot on the wire at a fixed position within the quiescent zone irrespective of wire motion at a point where the gas velocity along or across the wire are very low thereby permitting the wire to be rapidly melted, away from its arc side.

10. The apparatus as claimed in claim 5, wherein said means forming a primary jet stream of particulate materials suspended in a carrier gas comprises means supplying solid particles of abrasion materials into said high velocity gaseous accelerating stream jet at the quiescent zone and wherein, said means forming a high velocity gaseous secondary stream jet of non-circular geometry comprises an expansion nozzle body having a nozzle passage of non-circular geometry of its exit end and means for supplying said expansion nozzle with compressed air to create said quiescent zone.

* * * * *